United States Patent [19]

Arkans

[11] Patent Number: 5,017,100

[45] Date of Patent: May 21, 1991

[54] INTEGRAL PUMP AND CHECK VALVE APPARATUS

[76] Inventor: Edward J. Arkans, 9249 Glenoaks Blvd., Sun Valley, Calif. 91352

[21] Appl. No.: 506,025

[22] Filed: Apr. 9, 1990

[51] Int. Cl.[5] ..... F04B 43/04

[52] U.S. Cl. ..... 417/413; 417/454; 417/571; 137/903

[58] Field of Search ..... 417/360, 395, 413, 417, 417/454, 566, 571; 137/903, 540

[56] References Cited

U.S. PATENT DOCUMENTS

| | | | |
|---|---|---|---|
| 2,471,796 | 5/1949 | Thiberg | 417/571 X |
| 2,575,398 | 11/1951 | Schroeder | 417/571 |
| 3,192,949 | 7/1965 | DeGee | 137/903 X |
| 3,399,677 | 9/1968 | Gould et al. | 137/903 X |
| 3,467,020 | 9/1969 | Russell | 417/571 X |
| 3,545,897 | 12/1970 | Russell | 417/360 X |
| 3,900,276 | 8/1975 | Dilworth | 417/566 X |
| 4,137,016 | 1/1979 | Itakura | 417/413 |
| 4,162,876 | 7/1979 | Kolfertz | 417/413 |
| 4,594,058 | 6/1986 | Fischell | 417/413 |
| 4,762,470 | 8/1988 | Wang | 417/566 X |

*Primary Examiner*—Leonard E. Smith
*Assistant Examiner*—Eugene L. Szczecina, Jr.

[57] ABSTRACT

A combined and integral pump and check valve combination is disclosed herein for the control of fluid flow through a fluid pump portion having an inlet port leading to a gland cavity occupied by a movable sealing element yieldably held in position closing or sealing the inlet port by a self-biasing member such as an open-cell foam material. A retaining ring used during the assembly procedure is disposed between the edge marginal regions of the self-biasing member and the movable sealing element which may function to stabilize the element. A sealed retaining plate is attached to the pump supporting the self-biasing member and the movable element combination and further defines an outlet port or duct on the side of the movable element opposite to its side which is adjacent to the inlet port.

1 Claim, 1 Drawing Sheet

INTEGRAL PUMP AND CHECK VALVE APPARATUS

BACKGROUND OF THE INVENTION

1. Field of the Invention

The present invention relates to fluid pumps and more particularly to such a pump having an integral check valve employing a self-biasing spring means for yieldably moving a closure member to seal a fluid orifice.

2. Brief Description of the Prior Art

In the past, it has been the conventional practice to provide the body of a fluid pump with a gland or cavity having an inlet and an outlet with a closure means yieldable to open and close one of the orifices or ports. Such valves are normally identified as check valves for the control of fluid flow between the inlet and outlet orifices. Passive check valves are defined as those valves which have a movable element that is able to seal against an orifice. The movable element can be free to move against or away from the orifice or it may be spring-loaded against the orifice for biased closure. In the latter instance, a preselected fluid pressure may be required to unseat the movable element against the bias of a spring member in order to establish flow. The spring-loading ensures that fluid will not leak back into the pump's output orifice or port.

Conventional springs incorporating metal leaf springs, helical coils or the like have been used to place a bias on the movable member to effect yieldable sealing. These spring closures for check valves are usually expensive and require extensive assembly procedures during the construction of the fluid pump. Also, the spring member is not necessarily integral with the check valve so that added parts are required in conventional assemblages.

Therefore, a long-standing need has existed to provide a novel integral fluid pump and check valve combination in a unitary structure which is inexpensive compared with conventional metal springs and that can be cut to a desired shape. Preferably, the spring should be self-biased and act as a filter media.

SUMMARY OF THE INVENTION

Accordingly, the above problems and difficulties are obviated by the present invention which provides a novel fluid pump having an integral check valve disposed in a gland or cavity having an inlet and an outlet orifice or port. The check valve includes an assembly consisting of a movable sealing element which is backed by an open-cell foam member disposed in a slightly compressed configuration and which is yieldable to a preselected amount of fluid pressure applied through the inlet port against the movable sealing element. The edge marginal regions of the movable sealing element and the open-cell foam member operate so that the center of the member resiliently applies pressure against one side of the movable element so as to effect sealing.

Therefore, it is among the primary objects of the present invention to provide a combined pump and check valve having a self-biased member disposed in a sealing gland for yieldably urging pressure against a movable sealing element so as to effect control of fluid through the pump or valve structure.

Another object of the present invention is to provide a novel fluid pump and passive valve having an orifice and movable sealing element wherein the element is spring-loaded in a yieldable fashion against the orifice by a porous compliant material.

Another object of the present invention is to provide a novel fluid pump with an integral check valve having a self-biasing member applying yieldable pressure to a sealing element wherein the member is composed of a foam of a thermoset or thermoplastic polymer material such as polyester, urethane, silicon or polyvinyl chloride, cellulose or the like.

Yet another object of the present invention is to provide a novel check valve and a fluid pump which is inexpensive to manufacture and is integral and unitary in its self-biasing operation against a sealing member for the control of fluid through the pump.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF THE PREFERRED EMBODIMENT

Figure 1:
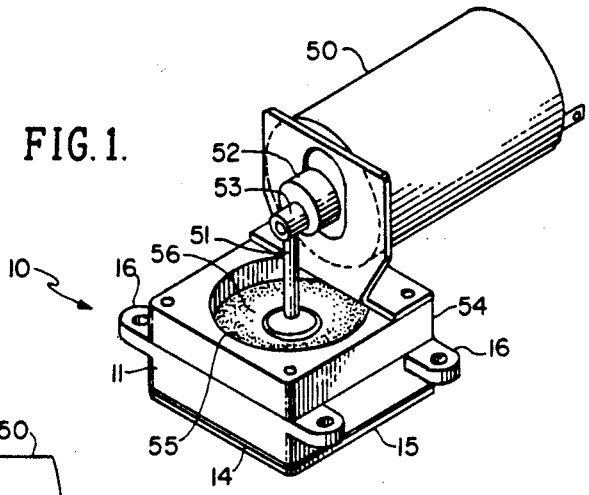
FIG. 1 is a front perspective view of a fluid pump incorporating the integral check valve in accordance with the present invention.

Referring to figures, the novel fluid pump incorporating the integral check valve is indicated in the general direction of arrow 10, which includes a main body 11 having an inlet orifice or port 12 and an outlet orifice or port 13 for conducting a pressurized fluid therebetween. The pump further includes a resilient seal 14 taking the form of a cushioned pad or the like and a retaining plate 15, which is held to the main body by means of screws. Mounting lugs are integrally formed with the body 11 and such a lug is represented by numeral 16. Each lug is provided with a mounting hole.

A motor 50 drives a connecting rod 51 in a continuous reciprocating movement via an eccentric cam 52 and a sleeve bearing 53. The motor is fixed to a tap retainer 54 by suitable screws and the connecting rod 51 projects through an opening 55 into securement with a flexible diaphragm 56. The movement of the connecting rod establishes a pumping action by moving the diaphragm back and forth so that fluid is drawn through the inlet port 12 into a cavity or gland 17.

In the example illustrated, a pair of check valve portions are shown, each arranged in operative position with respect to the inlet and outlet ports respectively. However, only one valve will be described as the other is identical.

Figure 2:
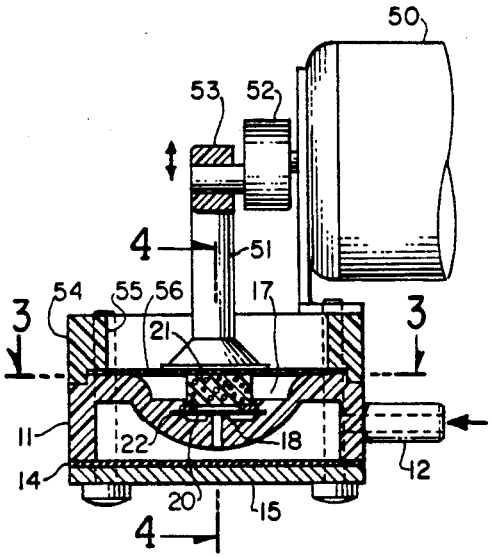
FIG. 2 is a transverse cross-sectional view of the pump shown in FIG. 1.

Referring now in detail to FIG. 2, it can be seen that the input orifice 12 leads into a cavity or gland 17 provided in the body 11 and that a ribbed seat 18 extends into the cavity 17 against which a movable sealing element 20 is pressed to close the orifice or port. The movable element 20 may be free to move against or away from the seat 18 or it may be spring-loaded against the orifice by means of an expansion spring means 21. In the latter case, a certain fluid pressure is required to unseat the movable elements, against the bias of the expansion spring 21, away from the orifice in order to establish flow. The spring-loading ensures that fluid will not leak back across the check valve into the pump's output port. A retaining ring 22 maintains the movable element 20 in position during assembly only and provides a central area through which the major portion of the spring means can extend into contact with the surface of the movable element 20 opposite from its surface contacting seat 18. Therefore, the spring-loaded valve is integral to the fluid pump.

In one form of the invention, the spring means may take the form of an elastomeric open-cell foam material. The foam material or block is constrained such that it is compressed and, therefore, applies force on the underside of the movable sealing element 20 so that it is forced or urged against the orifice seat 18.

Figure 4:
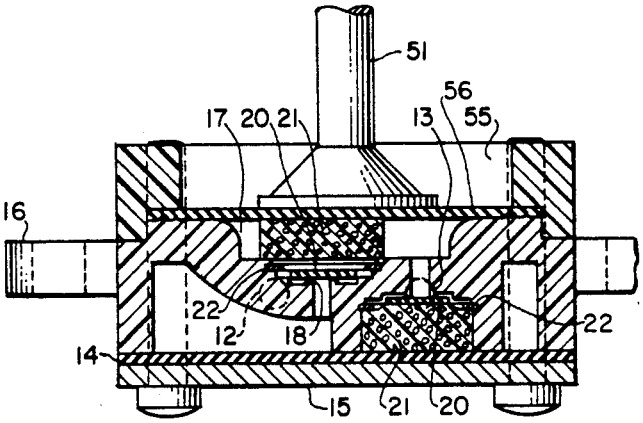
FIG. 4 is a longitudinal cross-sectional view of the fluid pump shown in FIG. 2 as taken in the direction of arrows 4—4 thereof.
Figure 3:
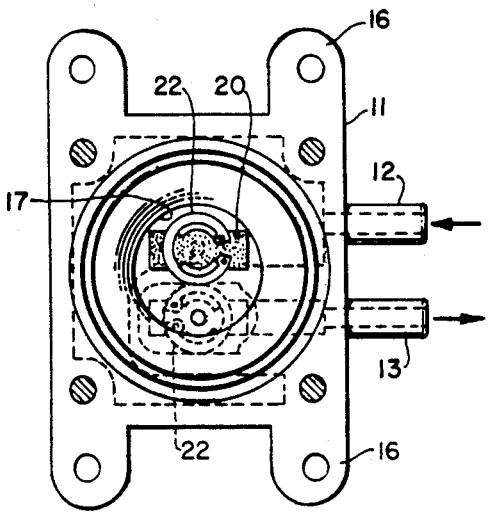
FIG. 3 is a cross-sectional view of the check valve portion of the pump as taken in the direction of arrows 3—3 of FIG. 2.

In FIGS. 3, 4, it can be seen that the retaining ring 22 is concentric with the orifice 12 and the central portion of the movable sealing element 20. By this means, the ring 22 holds or retains the terminating ends of the elongated sealing element 20 against the body 11 so that the central portion of the sealing means can move in a yieldable manner back and forth from the seat 18.

Additionally, the retaining ring 22 captures the edge marginal region of the element 20 so that its terminating ends are pressed against the sealing pad 14 and retaining plate 15. Therefore, the central portion of the block 21 is self-biasing through the center of the ring into contact with the side of the movable element 20 opposite from its side contacting or engaging the seat 18. The retaining ring 22 has the double function of retaining both the opposite ends of each of the sealing element 20 adjacent the self-biasing spring means 21 against the body. Therefore, the assembly is integral.

Figure 5:
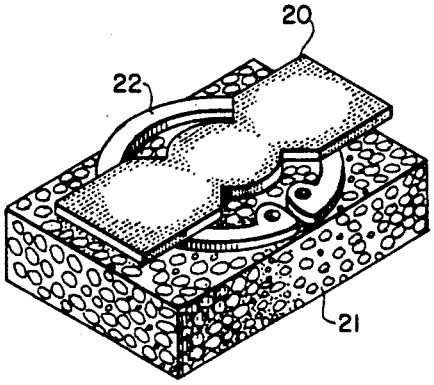
FIG. 5 is an enlarged perspective view showing the movable element and self-biasing member illustrated as an assembly in connection with an optional retaining ring.

In FIG. 5, the three basic elements of the sealing means included within the gland or cavity 17 are illustrated. It is to be understood that the self-biasing spring means 21 is of a porous material, such as an open-cell foam, so that fluid passing through the cavity will be substantially filtered as the flow progresses between the inlet and outlet orifices. The elastic modules of the foam is relatively low as compared to conventional spring materials, such as metal. One advantage resides in the fact that a greater tolerance on the foam's thickness is acceptable and the other advantage is that a low spring force is sufficient to seat the movable sealing element 20, yet avoids a significant back pressure to the pumping mechanism. Furthermore, the spring force can be selected by cutting the foam block to the appropriate thickness for the constraining cavity. Also, the foam materials can be selected to be nonreactive to a given fluid.

Alignment of the foam in the valve cavity 17 is not critical so long as some part of the sealing element 20 is covered by the foam 21. Therefore, the retaining ring 22 is not essential for operation but only used during assembly, if at all.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. In a fluid pump having an inlet orifice and an outlet orifice separated by an integral check valve, the improvement which comprises:

a housing body having a cavity interconnecting said inlet and said outlet orifices;

a fluid pump mounted on said body having a flexible diaphragm covering said cavity;

said check valve disposed in said body cavity adapted to regulate flow of fluid between said orifices;

said check valve consisting of a movable sealing element situated next to at least one of said orifices and a self-biasing means forcibly urging said movable sealing element into closure with said orifice;

said self-biasing means including a member composed or a foam-like composition compressed within said cavity and having a portion expandable into engagement with said movable sealing element to yieldably bias said movable sealing element into closure with said orifice;

said self-biasing member is composed of a porous, compliant material situated in the fluid path to filter and conduct the flow of fluid therethrough;

said self-biasing member is pre-shaped to conform in configuration to the shape of said cavity;

said fluid pump includes a motor mounted on said housing body interconnected with said flexible diaphragm by an eccentric cam and a reciprocating rod;

said sealing element is responsive to fluid pressure to seat and unseat with respect to said orifice;

said flexible diaphragm separates said connected rod and said self-biasing means;

said self-biasing means being disposed between said flexible diaphragm and said sealing element;

said sealing element is an elongated flexible strip having a circular midsection coaxially disposed with respect to said orifice; and means cooperating with said housing body for retaining said sealing element in said coaxial related disposition.

* * * * *